US006604458B1

(12) United States Patent
De Volder

(10) Patent No.: US 6,604,458 B1
(45) Date of Patent: Aug. 12, 2003

(54) PRESSURIZED PAD FOR PRINTING THREE-DIMENSIONAL SPHERICAL OR CURVED OBJECTS

(76) Inventor: Laurent De Volder, Aalterstraat 11, Aalter (BE), B-9880

( * ) Notice: Subject to any disclaimer, the term of this patent is extended or adjusted under 35 U.S.C. 154(b) by 0 days.

(21) Appl. No.: 09/958,388

(22) PCT Filed: Apr. 10, 2000

(86) PCT No.: PCT/BE00/00032

§ 371 (c)(1),
(2), (4) Date: Jan. 4, 2002

(87) PCT Pub. No.: WO00/61371

PCT Pub. Date: Oct. 19, 2000

(30) Foreign Application Priority Data

Apr. 8, 1999 (BE) ..... 9900245

(51) Int. Cl.[7] ..... B41F 17/00
(52) U.S. Cl. ..... 101/41; 101/163; 101/170
(58) Field of Search ..... 101/35, 41, 379, 101/331, 34, 163, 170

(56) References Cited

U.S. PATENT DOCUMENTS 2,748,696 A * 6/1956 Murray et al. ..... 101/41
2,904,916 A * 9/1959 Stahmann ..... 101/35
3,756,165 A * 9/1973 Valiela ..... 101/483
3,868,901 A * 3/1975 Valiela ..... 101/41
4,098,184 A * 7/1978 Okada et al. ..... 101/41
4,511,425 A * 4/1985 Boyd et al. ..... 156/493

FOREIGN PATENT DOCUMENTS

WO WO 87/00796 2/1987

* cited by examiner

*Primary Examiner*—Andrew H. Hirshfeld
*Assistant Examiner*—Andrea A. Hence
(74) *Attorney, Agent, or Firm*—Barry R. Lipsitz

(57) ABSTRACT

Apparatus is disclosed for printing three-dimensional objects, particularly objects having a substantially spherical shape. A pad is provided for printing by means of pad printing. The pad has a silicon shape with a determined thickness, and is mounted on a hollow pad holder made of an undeformable material which constitutes an isolated space together with the silicon shape. The pad is supplied with compressed air and is connected to a pressure vessel by means of a main element provided therefor through an opening. The apparatus is arranged in open loop, wherein there is provided an additional separate aperture for a separate inlet and outlet of air, with a pressure regulating unit enabling the pressure in the pad to be maintained greater than or at a preset level P. The pressure regulating unit regulates the compressed air which enters the regulator through a supply main.

17 Claims, 4 Drawing Sheets

PRESSURIZED PAD FOR PRINTING THREE-DIMENSIONAL SPHERICAL OR CURVED OBJECTS

FIELD OF THE INVENTION

This invention relates to a flexible stamp apparatus for printing three dimensional spherical and/or curved objects.

PRIOR ART

It is presently known to use a hollow, half silicon spherical shape for printing spherical objects, such as toy balls. This silicon shape has a thickness of about 2 cm and it is mounted on a hollow flexible stamp or pad holder. The silicon shape and the pad holder are designated hereafter as the "the pad".

The pad holder is made of an undeformable material and has the shape of a drum. It forms together with the silicon shape, an hermetically closed space having only one aperture as contact with the outside. At this sole aperture, a flexible tube having a sufficiently great diameter is connected to a pressure vessel. Said pressure vessel is not represented at scale. This pressure vessel needs to have a volume which can contain 10 to 100 times the volume of the pad indeed. The pressure vessel is yet generally kept under a light over-pressure by means of a separate pressure regulator.

This construction serves for keeping the pressure in the pad as constant as possible during the printing cycle. Indeed, a pressure variation in the pad results in the dilatation or the retraction of the silicon part. Owing to this, the image on the silicon part becomes bigger or smaller with a bad printing quality on the printed spherical objects. The different times of the printing cycle of the prior art show subsequently a rest position wherein the pressure in the pad is equal to the one in the pressure vessel. This pressure is designated hereafter with the reference P.

The pad is moved from the rest position to said object to be printed in a relative movement according to arrow F and it bends over the object to be printed. The air in the pad is pressed to the pressure vessel through the flexible tube. However, despite the fact that the volume of the pressure vessel is several times greater than the content of the pad, this displacement of air volumes yet results in a slight increase of the pressure in the pad and vessel, which is designated hereafter by the reference P'.

After this, the pad returns to its original state according to the direction of arrow F, i.e. to the rest position. The air now moves back from the pressure vessel to the pad. The pressure in the system now becomes greater than P, which is referred to hereafter with P", but during this part of the cycle, the latter decreases again so as to become pressure P again.

This above-mentioned known system is a closed circuit wherein the air, which is pressed out of the pad during the printing and inking stage, goes back to the pressure vessel. When the pad goes back to its original position, the air returns to the pad again from the pressure vessel.

The great advantage of this system consists in that despite the fact that the volume of the pressure vessel is several times greater than the volume of the pad, there is still a small pressure variation, i.e. P, P', P", which affects unfavourably the printing quality during the pad action on the objects to be printed.

AIM OF THE INVENTION

This invention aims at remediating the above-mentioned drawback. Thus in this invention, a hollow pad as above is used, wherein instead of using a closed circuit, the pad is now incorporated in an open circuit according to the invention.

Not withstanding that the apparatus according to the invention has a lower air consumption, it yet enables determining the pressure in the pad in a very accurate way at each time of the printing cycle. This is a very important parameter for printing at least partially spherical objects, particularly in connection with the printing quality thereof, the importance whereof increases as nowadays the requirements set for the printing quality are always becoming stronger.

Further properties and particularities are defined in the appended claims.

Some exemplary embodiments of the system according to the invention are described hereafter in the light of the appended drawings.

This invention also relates to a process for printing at least partially spherical and/or curved three dimensional objects. It is to be understood that a substantially differentiating element in this invention consists in that an open loop is used here and not a closed loop, wherein in addition the inlet side and the outlet of the pad are clearly separated from each other. Thanks to this specific process according to the invention a remarkably higher printing quality is achieved.

DESCRIPTION

Figure 1:
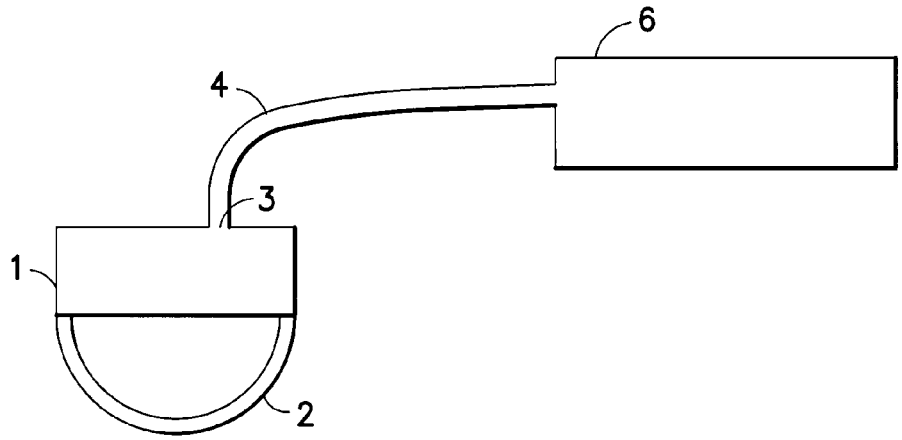
FIG. 1 PRIOR ART
FIG. 1 is a schematic representation of a closed pad system for printing spherical objects such as known from the prior art.
Figure 3:
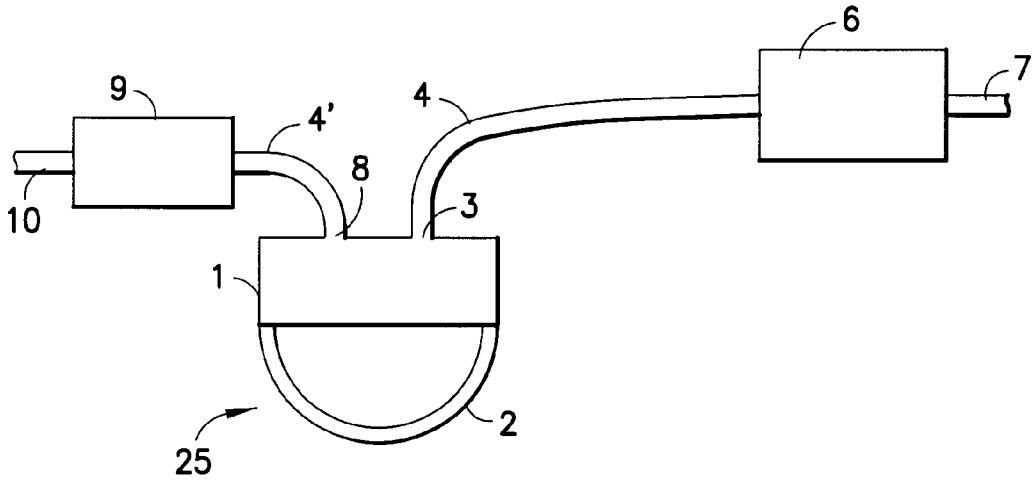
FIG. 3 is a schematic representation of an open system with a pad for printing spherical objects according to the invention.
Figure 2A:
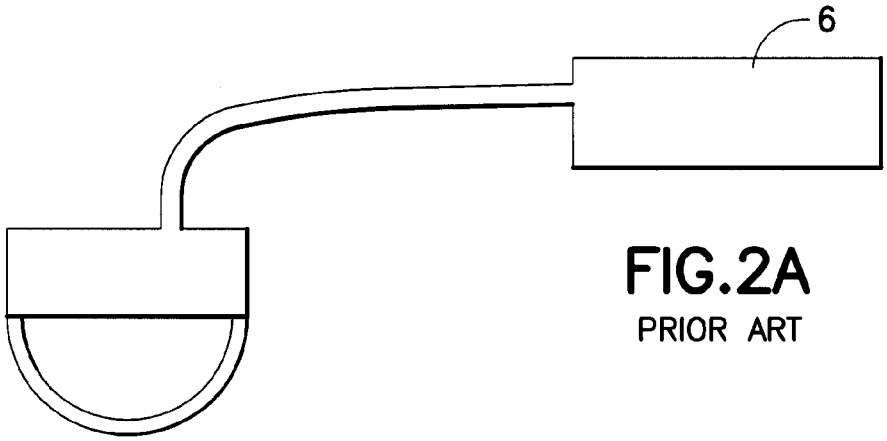
FIG.2A PRIOR ART
FIGS. 2*a* to 2*c* are schematic representations of the various steps and states of the known system during a (complete) working cycle.
Figure 2B:
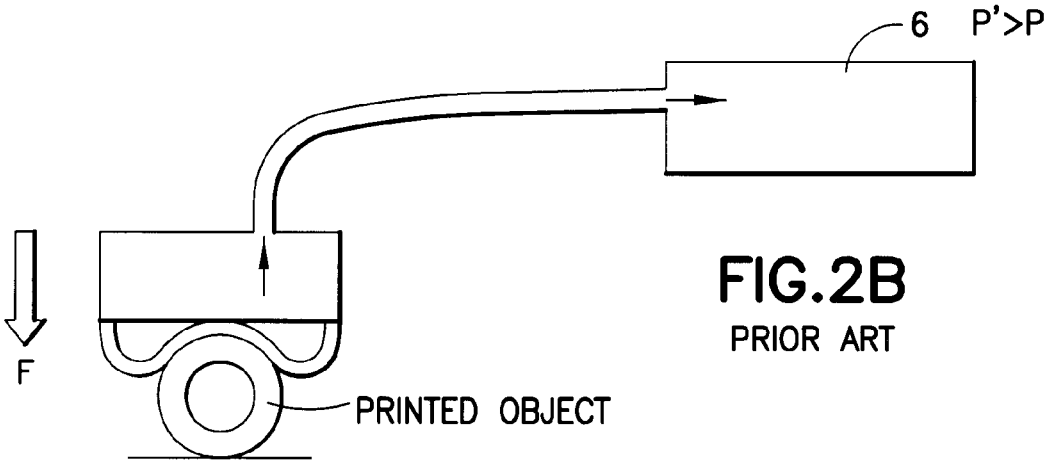
FIG.2B PRIOR ART
Figure 2C:
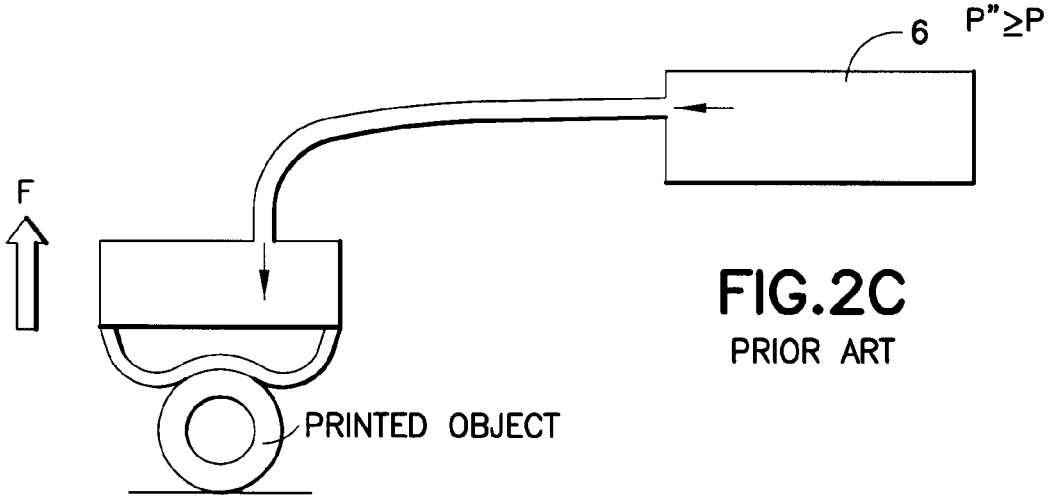
FIG.2C PRIOR ART

FIG. 1 shows an apparatus with a pad holder 1 and a so-called silicone shape 2 which are comparable to the present prior art. However, in this pad holder 1, there is provided in addition to a traditional aperture 3 an additional aperture 8, resulting in that the system presents separate apertures for the inlet 3 of the air and respectively the outlet 8 of the air through a conduit 4, resp. 4' provided therefor. A fast and accurate pressure regulating unit 6 which is incorporated in the inlet 4 causes the pressure in the pad 25 never to fall under a preset level established at pressure P. Therefor the pressure regulating unit adjusts the compressed air which enters the regulator 6 through a supply flexible tube 7 according to F. An accurate and fast over-pressure valve 9 is connected to the outlet hole 8. As soon as the pressure in the pad 25 becomes greater than the preset value of the pressure P, the over-pressure valve 9 will blow off according to 6' to the outer air 40 through the outlet 10.

Different embodiments are described hereinafter after the preliminary description of how the above described basic embodiment of the apparatus according to the invention works.

Figure 4:
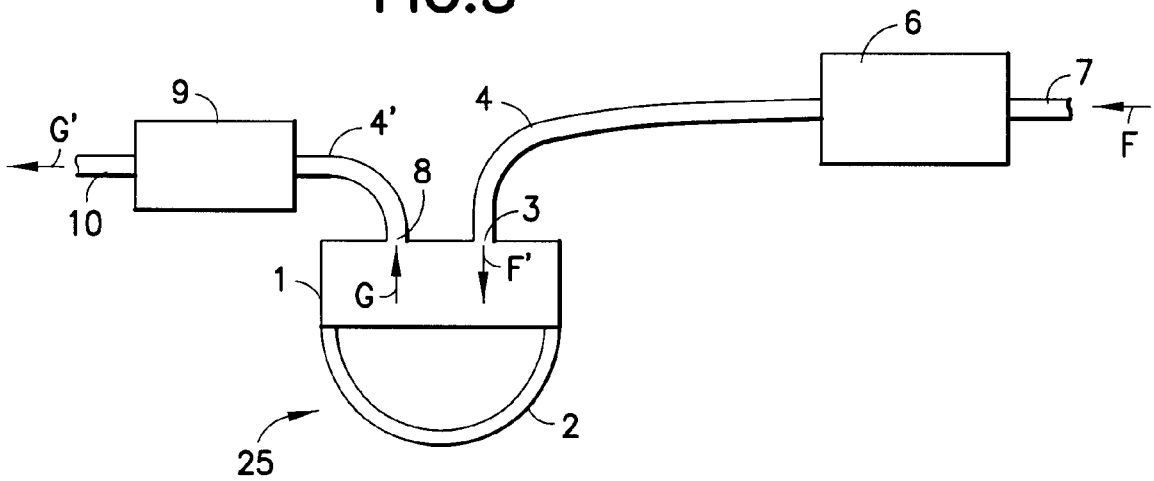
FIG. 4 is the functional representation of the schematic view of the apparatus according to the invention according to FIG. 3.
Figure 4A:
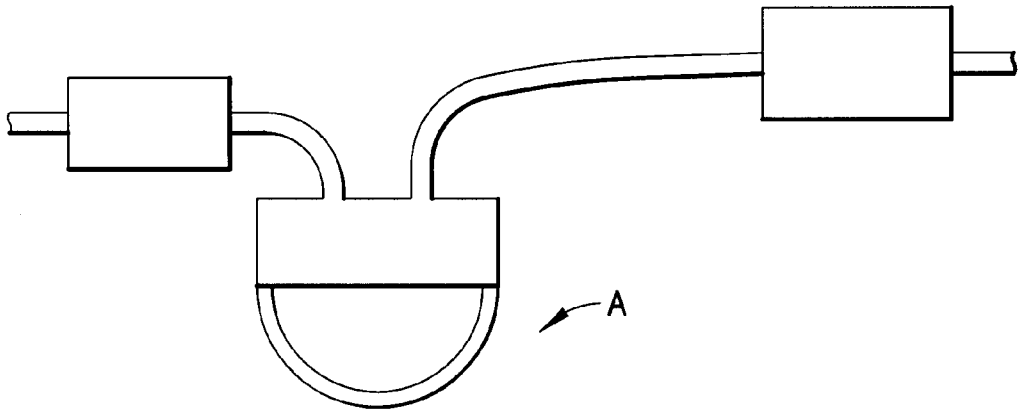
FIGS. 4*a* to 4*c* represent in a schematic way the various steps and states of the apparatus according to the invention as represented in FIG. 4 in its basic embodiment.

FIG. 4*a* shows the apparatus in rest position represented by A. There is a constant pressure P in the pad 25. Both the pressure regulating system 6 and the over-pressure valve 9 are in a closed position.

Figure 4B:
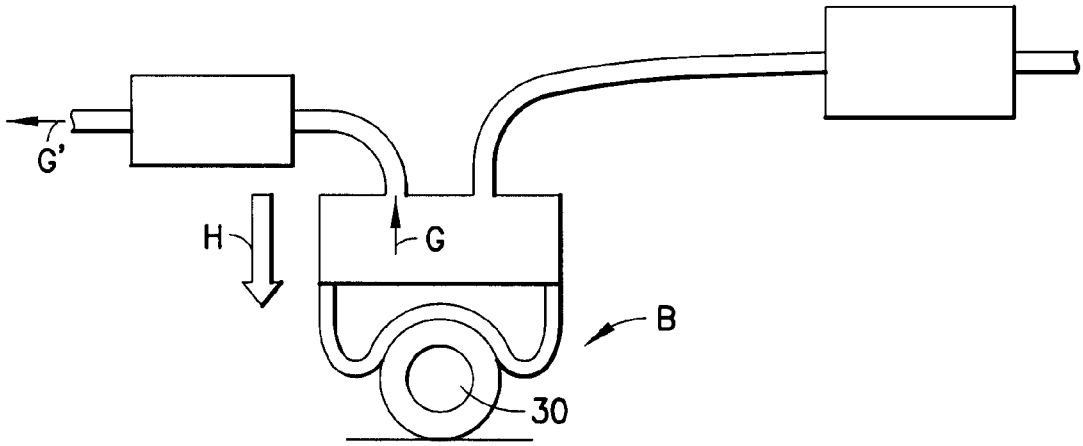

FIG. 4*b* shows how the pad 25 moves downwards according to arrow H and how it bends over the object 36 to be printed (state B). The air in the pad 25 is pressed out of the pad according to G through the over-pressure valve 9 to the outside 40 according to the arrow direction G'. The pressure in the pad thus remains pressure P.

Figure 4C:
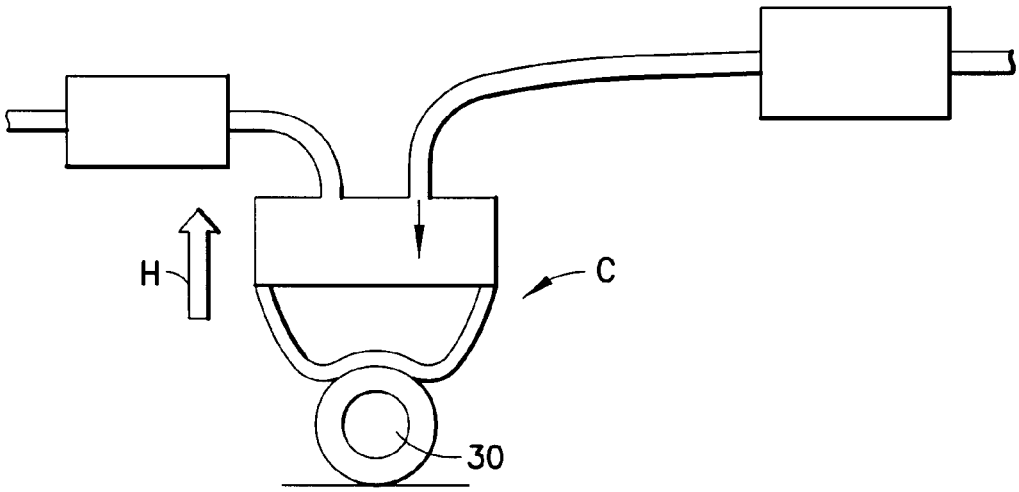

FIG. 4*c* shows the subsequent state C wherein the pad 25 goes upwardly again according to—H, i.e. to the rest position A. The over-pressure valve 9 got closed and the pressure regulating unit 8 enters into action. The pressure regulating unit 6 will keep the pressure at pressure P by blowing the right quantities of air in the pad 25.

Despite the fact that the system according to the invention consumes more air, it enables determining very accurately the pressure in the pad 25 at each time of the printing cycle. This is a very important parameter for printing spherical objects 30, particularly with respect to the printing quality thereof, since printing quality requirements continually increase.

Different embodiments and alternatives of the apparatus according to the invention are described hereinafter with FIGS. 6 and 7. The selection of a particular embodiment depends on various factors, such as printing speed, cost of the system and desired accuracy of the printing.

Figure 5:
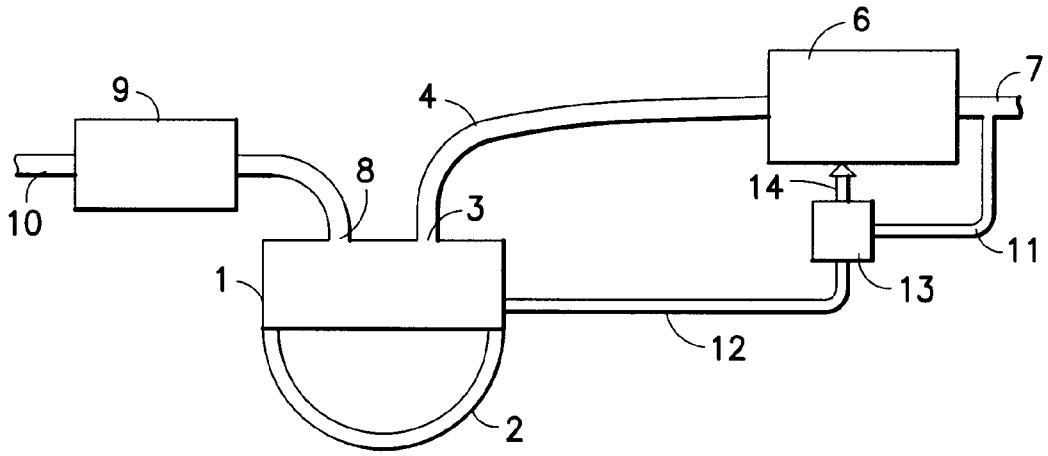
FIG. 5 is the representation of a first alternative of the apparatus with pad for printing spherical objects according to the invention as represented schematically in a basic embodiment in FIG. 4.

An alternative of the system with pad 25 with mechanical valves 6, 9 as described above brings a solution to the above-mentioned requirement for finding accurate and quick valves which are yet able to supply the required flow provided that an additional pilot valve 13 is incorporated in the system as shown on FIG. 5.

In this Figure, said pilot valve 13 is connected directly on the air supply main 7 through a compressed air conduit 11. Further said pilot valve 15 is also directly connected to the pad 25, particularly the pad holder 1, through a measuring tube 12. Said pilot valve is also directly connected to said pressure regulating unit 6 through a control pressure conduit 14.

The latter alternative thus shows a pad 25 with mechanical valves 6, 9 and a pilot valve 13, wherein this pilot valve is fed through the compressed air conduit 11. Through the measuring tube 12 the pressure in the pad 25 is measured by the pilot valve 13 and the pressure regulating system 6 is controlled through the control pressure conduit 14.

Figure 6:
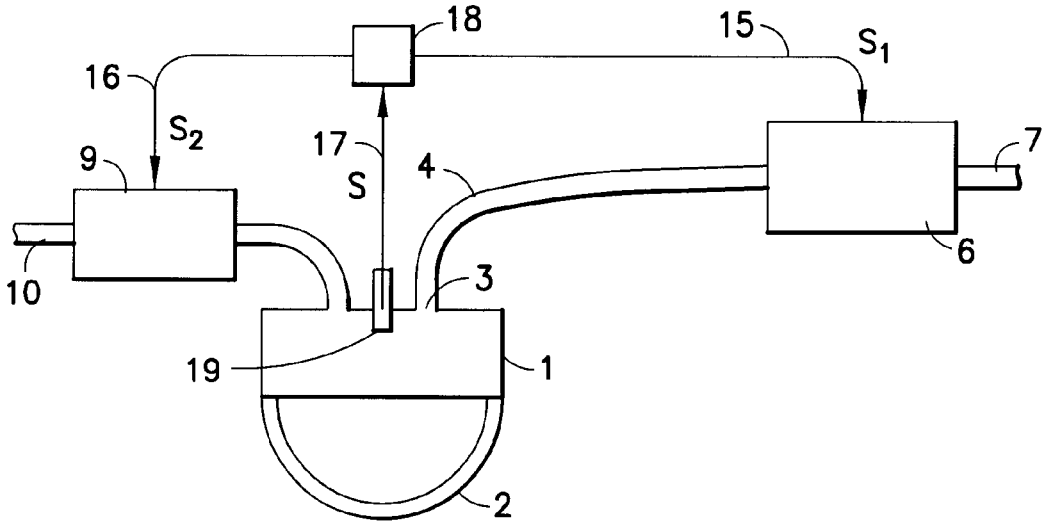
FIG. 6 is the representation of a further alternative of the apparatus with pad for printing spherical objects according to the invention.

FIG. 6 shows a further alternative of the system which comprises a pad 25 with pressure sensors 19 and an electronical control unit 18. One or a plurality of pressure sensors 19 are incorporated in this alternative of the system at the pad 25, particularly the pad holder 1, with a direct connection to an electronical control unit 18 through a conduit 17. Said electronical control unit 18 is in turn connected to an electronical valve 6 at the admission side on the one hand and with a over-pressure valve 9 of the same type as above on the other hand, in each case through a respective signal carrier 15 and 16.

The electronical pressure sensor 19 measures continuously the right pressure of the pad 25, wherein this information is taken up in the sensor signal s that is delivered by said pressure sensor 19.

This alternative of embodiment shows at the input side between the pad 25 and the input 7 a simple pressure regulator 22 with a buffer vessel 20 streamdownwardly of the supplied compressed air, which is incorporated in the supply main 4, wherein a nonreturn valve 21 is provided at the inlet of the pad 25.

At the output of said pad, there is provided the same outlet branch as in the above alternatives, i.e. with an over-pressure valve 9.

The sensor signal s is transmitted to an electronic control unit 18, such as, e.g. a PLC, a micro-controller, a PC, an electronical regulator, and the like. In case the measured pressure lies under the programmed value, an electronic valve 6 is opened by a signal $s_1$ along the conduit 15 in order to admit compressed air in the pad 25 through the supply main. In case the pressure in the pad 25 is greater than the value programmed in the control unit 18, another signal $s_2$ is sent to the electrical desaerating valve 9 through the conduit 16.

Figure 7:
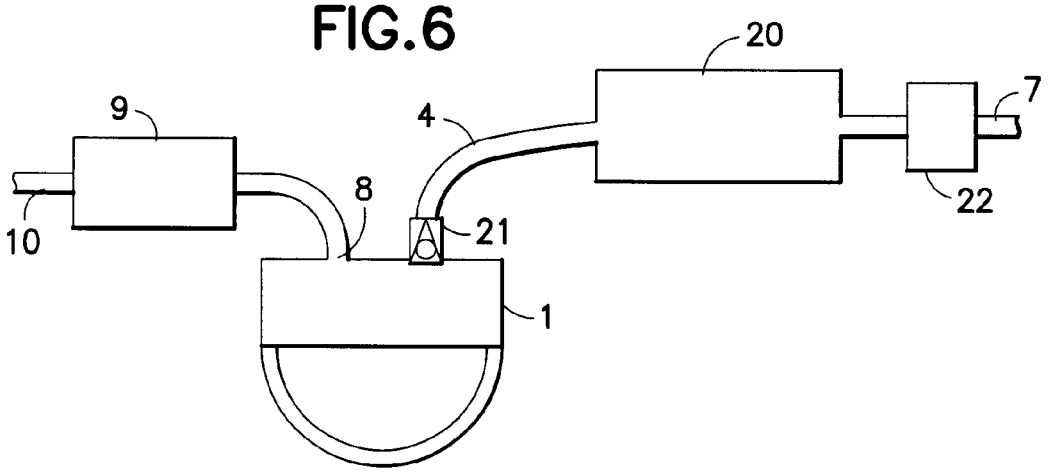
FIG. 7 is the representation of a still further alternative of the apparatus with pad for printing spherical objects according to the invention.

FIG. 7 shows a still further alterntive of embodiment which comprises a pad 25 with a buffer vessel and a nonreturn valve. In this embodiment, the same over-pressure valve 9 is used as in the basic embodiment above as shown in FIGS. 5 and 3 to 4*c*. However, the inlet is supplied here through a simple pressure regulator 22 which builds up a preset pressure in said buffer vessel 20 in between the printing cycles. An nonreturn valve 21 prevents the air which is pressed out of the pad 25 during a printing stage from returning to the buffer vessel 20, since this would increase the pressure in the buffer vessel. The air pressed out of the pad leaves the system through the over-pressure valve 9 as above. The supply main 4 has a sufficient diameter so as to be able to supply the required air flow each time the pad goes up again away from the printed object 30 after an inking or printing cycle.

It is further yet possible to use combinations of the embodiments described above, wherein it is to be understood that said combinations fall within the scope of protection of this application.

The process for printing surfaces of an object by means of the above-described apparatus consists in first pressing the pad against an initially inked surface, in an open loop, whereupon the half spherical surface of the pad, which is in close contact with this inked surface, is flattened so that the figures to be printed are transferred on the surface of the pad, in subsequently removing said pad from the original surface in order to enable the latter to recover its initial half spherical shape again, and in subsequently pressing said pad against the three dimensional spherical and/or curved surface in such a way that said pad encompasses at least a spherical or curved part of said object, and in bringing the pad surface bearing the inked figure in contact with the surface of said object, thereby to transfer this inked figure on the desired spherical or curved part of the receiving object.

What is claimed is:

1. Apparatus for printing three-dimensional objects, comprising:

a pad for printing by means of pad printing, said pad being made of silicone with a determined thickness and shape, and being mounted on a hollow pad holder made of an undeformable material which constitutes an isolated space together with said silicone pad, said pad being adapted to receive compressed air and being coupled to a pressure vessel by means of a main element provided therefor through an opening, the apparatus being arranged in an open loop wherein there is provided an additional separate aperture for a separate inlet and outlet of air with a pressure regulating unit to maintain the pressure in the pad at least at a preset level P, and said pressure regulating unit being adapted to regulate compressed air which enters the regulating unit through a supply main.

2. Apparatus according to claim 1, further comprising an over-pressure valve connected to the outlet of the pad holder through a discharge conduit.

3. Apparatus according to claim 2, wherein the pad is provided with a pilot valve connected to a compressed air main, and with a measuring unit for measuring the pressure in the pad and controlling the pressure regulating unit through a control pressure conduit, which mutually connects the pilot valve and the pressure regulating unit.

4. Apparatus according to claim 3, wherein:

said pad comprises a buffer vessel and a nonreturn valve, the inlet is provided with a pressure regulator which builds up a preset pressure between printing cycles in said buffer vessel, said nonreturn valve prevents air which is pressed out of the pad from returning to the buffer vessel during a printing stage, subsequently the air pressed out from the pad leaves the apparatus through an over-pressure valve, and the supply main has a sufficient diameter for supplying the needed air flow each time the pad returns to its rest position after an inking or printing cycle.

5. Apparatus in accordance with claim 3, wherein said pad comprises pressure sensors for measuring the pressure of the pad, wherein at least one signal delivered by said sensors is transmitted to an electronic control unit.

6. Apparatus according to claim 5, wherein:

said pad comprises a buffer vessel and a nonreturn valve, the inlet is provided with a pressure regulator which builds up a preset pressure between printing cycles in said buffer vessel, said nonreturn valve prevents air which is pressed out of the pad from returning to the buffer vessel during a printing stage, subsequently the air pressed out from the pad leaves the apparatus through an over-pressure valve, and the supply main has a sufficient diameter for supplying the needed air flow each time the pad returns to its rest position after an inking or printing cycle.

7. Apparatus in accordance with claim 2, wherein said pad comprises pressure sensors for measuring the pressure of the pad, wherein at least one signal delivered by said sensors is transmitted to an electronic control unit.

8. Apparatus according to claim 7, wherein:

said pad comprises a buffer vessel and a nonreturn valve, the inlet is provided with a pressure regulator which builds up a preset pressure between printing cycles in said buffer vessel, said nonreturn valve prevents air which is pressed out of the pad from returning to the buffer vessel during a printing stage, subsequently the air pressed out from the pad leaves the apparatus through an over-pressure valve, and the supply main has a sufficient diameter for supplying the needed air flow each time the pad returns to its rest position after an inking or printing cycle.

9. Apparatus according to claim 2, wherein:

said pad comprises a buffer vessel and a nonreturn valve, the inlet is provided with a pressure regulator which builds up a preset pressure between printing cycles in said buffer vessel, said nonreturn valve prevents air which is pressed out of the pad from returning to the buffer vessel during a printing stage, subsequently the air pressed out from the pad leaves the apparatus through an over-pressure valve, and the supply main has a sufficient diameter for supplying the needed air flow each time the pad returns to its rest position after an inking or printing cycle.

10. Apparatus according to claim 1, wherein the pad is provided with a pilot valve connected to a compressed air main, and with a measuring unit for measuring the pressure in the pad and controlling the pressure regulating unit through a control pressure conduit, which mutually connects the pilot valve and the pressure regulating unit.

11. Apparatus in accordance with claim 10, wherein said pad comprises pressure sensors for measuring the pressure of the pad, wherein at least one signal delivered by said sensors is transmitted to an electronic control unit.

12. Apparatus according to claim 11, wherein:

said pad comprises a buffer vessel and a nonreturn valve, the inlet is provided with a pressure regulator which builds up a preset pressure between printing cycles in said buffer vessel, said nonreturn valve prevents air which is pressed out of the pad from returning to the buffer vessel during a printing stage, subsequently the air pressed out from the pad leaves the apparatus through an over-pressure valve, and the supply main has a sufficient diameter for supplying the needed air flow each time the pad returns to its rest position after an inking or printing cycle.

13. Apparatus according to claim 10, wherein:

said pad comprises a buffer vessel and a nonreturn valve, the inlet is provided with a pressure regulator which builds up a preset pressure between printing cycles in said buffer vessel, said nonreturn valve prevents air which is pressed out of the pad from returning to the buffer vessel during a printing stage, subsequently the air pressed out from the pad leaves the apparatus through an over-pressure valve, and the supply main has a sufficient diameter for supplying the needed air flow each time the pad returns to its rest position after an inking or printing cycle.

14. Apparatus in accordance with claim 1, wherein said pad comprises pressure sensors for measuring the pressure of the pad, wherein at least one signal delivered by said sensors is transmitted to an electronic control unit.

15. Apparatus according to claim 14, wherein:

said pad comprises a buffer vessel and a nonreturn valve, the inlet is provided with a pressure regulator which builds up a preset pressure between printing cycles in said buffer vessel, said nonreturn valve prevents air which is pressed out of the pad from returning to the buffer vessel during a printing stage, subsequently the air pressed out from the pad leaves the apparatus through an over-pressure valve, and the supply main has a sufficient diameter for supplying the needed air flow each time the pad returns to its rest position after an inking or printing cycle.

16. Apparatus according to claim 1, wherein:

said pad comprises a buffer vessel and a nonreturn valve, the inlet is provided with a pressure regulator which builds up a preset pressure between printing cycles in said buffer vessel, said nonreturn valve prevents air which is pressed out of the pad from returning to the buffer vessel during a printing stage, subsequently the air pressed out from the pad leaves the apparatus through an over-pressure valve, and the supply main has a sufficient diameter for supplying the needed air flow each time the pad returns to its rest position after an inking or printing cycle.

17. A process for printing a three dimensional surface of an object by means of a deformable pad having a half spherical shape and being supplied with compressed air through an opening, comprising the steps of:

first pressing the pad in an open circuit against an initially inked surface, whereupon the half spherical surface of the pad, which is in close contact with the inked surface, is flattened so that the figures to be printed are transferred on the surface of the pad, said open circuit comprising an additional separate inlet and outlet of air with a pressure regulating unit to maintain the pressure in the pad at least at a preset level P, subsequently removing said pad from the initially inked surface in order to enable it to recover its initial half spherical form again, subsequently pressing said pad against the three-dimensional surface in such a way that said pad encompasses at least a spherical or curved part of said object, and bringing the pad surface bearing the inked figure into contact with the surface of said object thereby to transfer this inked figure on the desired spherical or curved part of the receiving object.

* * * * *